US007024322B2

(12) United States Patent
Kolman et al.

(10) Patent No.: US 7,024,322 B2
(45) Date of Patent: Apr. 4, 2006

(54) DYNAMIC WAVEFORM RESOURCE MANAGEMENT

(75) Inventors: Robert S. Kolman, Longmont, CO (US); Reid Hayhow, LaPorte, CO (US); Daven Walt Septon, Loveland, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 70 days.

(21) Appl. No.: 10/782,984

(22) Filed: Feb. 20, 2004

(65) Prior Publication Data

US 2005/0187729 A1 Aug. 25, 2005

(51) Int. Cl.
*G01R 13/02* (2006.01)

(52) U.S. Cl. ..... 702/67; 702/66; 702/70; 714/1; 714/4; 714/33; 714/38; 714/46

(58) Field of Classification Search ..... 702/67, 702/66, 70–73, 80; 345/501; 714/4, 33, 714/38, 1, 46
See application file for complete search history.

(56) References Cited

U.S. PATENT DOCUMENTS 5,371,851 A * 12/1994 Pieper et al. ..... 345/501
5,657,438 A * 8/1997 Wygodny et al. ..... 714/1
5,905,856 A * 5/1999 Ottensooser ..... 714/38
6,134,674 A * 10/2000 Akasheh ..... 714/33
6,188,407 B1 * 2/2001 Smith et al. ..... 715/841
6,360,332 B1 * 3/2002 Weinberg et al. ..... 714/4
6,587,969 B1 * 7/2003 Weinberg et al. ..... 714/46

* cited by examiner

*Primary Examiner*—John Barlow
*Assistant Examiner*—Hien Vo

(57) ABSTRACT

A dynamic waveform manager and an application policy are provided to an electronic device that executes an application requiring the use of waveforms accessed from a waveform table characterized by a limited number of entries. The application policy contains waveform sequencing information specific to the application. The application may utilize any number of waveforms that are typically stored in a memory separate from the waveform table. The dynamic waveform manager monitors the execution of the application, and manages loading and unloading of waveforms required by the application into and out of the waveform table such that each waveform required by the application is loaded in the waveform prior to and at least by the time it is needed by the application. The dynamic waveform manager accesses the application policy to reference the waveform sequencing information specific to the application for use in determining when and which waveforms to load and unload to and from the waveform table.

19 Claims, 7 Drawing Sheets

230

| WAVEFORM IDENTIFIER | FIRST USE (PRIORITY) | LAST USE |
|---|---|---|
| $WF_1$ | $TS_1$ | $TS_1$ |
| $WF_2$ | $TS_2$ | $TS_2$ |
| $WF_3$ | $TS_5$ | $TS_5$ |
| $WF_4$ | $TS_3$ | $TS_3$ |
| $WF_5$ | $TS_6$ | $TS_6$ |
| $WF_6$ | $TS_4$ | $TS_8$ |
| $WF_7$ | $TS_9$ | $TS_9$ |
| $WF_8$ | $TS_7$ | $TS_{10}$ |

DYNAMIC WAVEFORM RESOURCE MANAGEMENT

BACKGROUND OF THE INVENTION

Present day electronic devices must often generate one or more waveform signals as part of their functionality. For example, a waveform generator may be configured to generate any number of different waveforms that may be output by the device. As another example, automated integrated circuit testers such as the Agilent 93000 SOC Series Automated Tester Environment (ATE), manufactured by Agilent Technologies, Inc. of Palo Alto, Calif., may require generation of waveform signals on various pins of the tester for application to pins or pads of an integrated circuit device under test (DUT).

Electronic devices that produce waveform signals often store representations of the waveform signals (hereinafter referred to as "waveforms") in dedicated waveform registers or memory (collectively referred to hereinafter as "waveform table"). Memory is always a limiting factor in the number of waveforms that may be stored in the waveform table. Therefore, the number of registers or locations in memory (collectively referred to hereinafter as "waveform table entries") available for storing waveforms is limited. Cost and speed are limiting factors in the size of the waveform table. Typically, fast memory is required for waveform generating circuitry, and fast memory is more expensive. Accordingly, a common solution is to simply limit the number of waveforms that can be generated by the hardware.

Situations exist, however, where it may be desirable to be able to expand the number of waveforms available by a test program beyond a limited number of waveforms that may be generated by the hardware. In an integrated circuit tester, for example, test software generates test programs that may be executed by tester resources to generate waveforms on various pins of the tester for application to pins and pads of an integrated circuit under test to test various aspects of the integrated circuit. However, since the waveform table can store only a limited number of waveforms, and the waveforms must be available for generation of the waveforms on the tester pins, the test software typically limits the number of waveforms that any given test program generated by the test software may define to the number of available waveform table entries. However, it would be desirable in many applications, for example in memory test applications, to be able to generate a number of waveforms that exceed the number of waveforms limited by the size of the waveform table. Currently, no technique exists for such expansion without altering the hardware.

SUMMARY OF THE INVENTION

The present invention is a method and system for expanding the number of waveforms that may be generated by a device characterized by limited waveform memory capacity.

In accordance with the invention, an electronic device that executes an application requiring the use of waveforms accessed from a waveform table characterized by a limited number of entries, is configured with a dynamic waveform manager and an application policy that contains waveform sequencing information specific to the application. The application may utilize any number of waveforms that are typically stored in a memory separate from the waveform table. The application requires that a waveform be loaded into the waveform table prior to its use of the particular waveform. The dynamic waveform manager of the invention monitors the execution of the application, and manages loading and unloading of waveforms required by the application into and out of the waveform table such that each waveform required by the application is loaded in the waveform prior to and at least by the time it is needed by the application. The dynamic waveform manager accesses the application policy to reference the waveform sequencing information specific to the application for use in determining when and which waveforms to load and unload to and from the waveform table.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION

Figure 1:
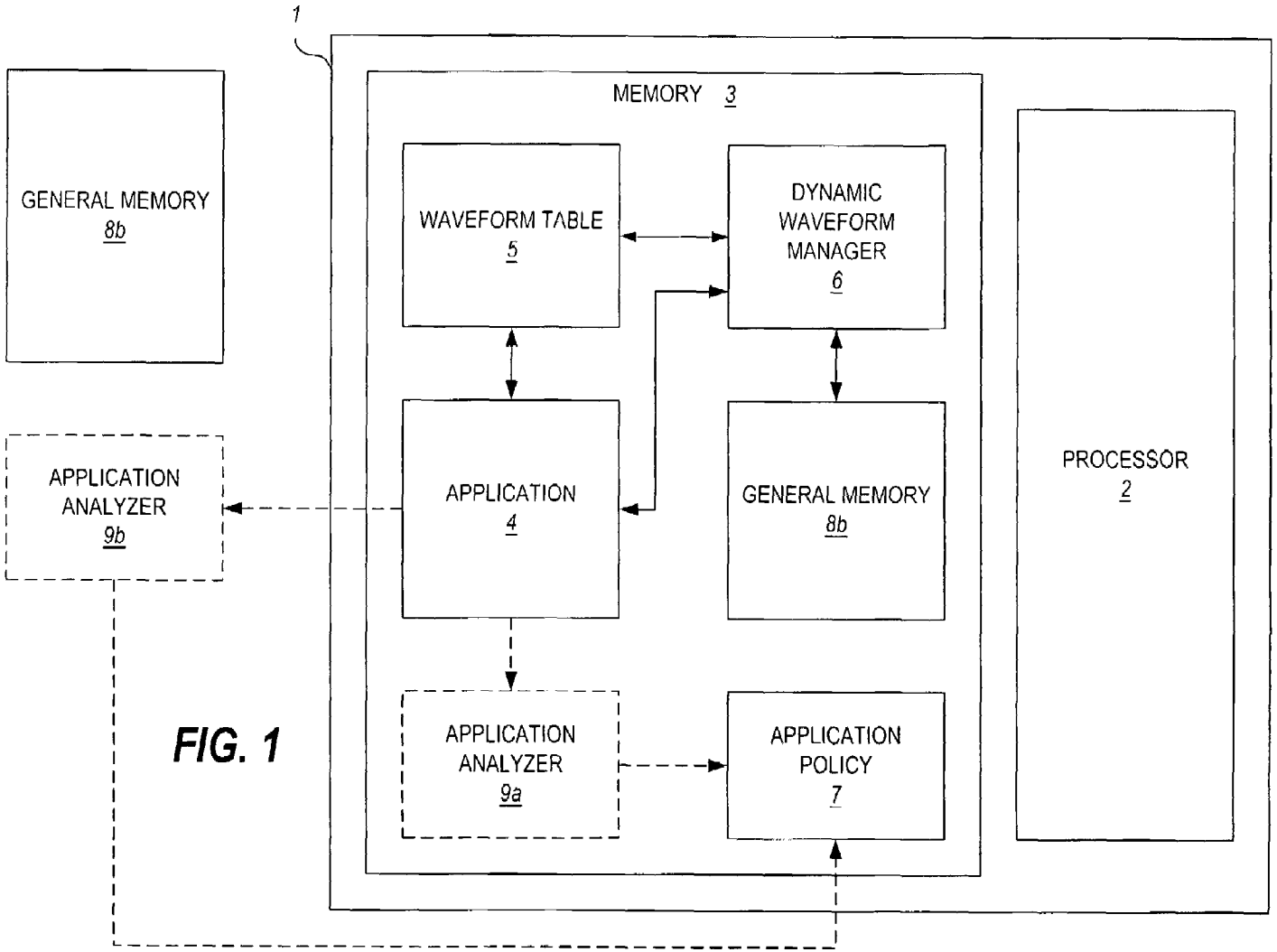
FIG. 1 is a block diagram of an electronic device illustrating the invention.

Turning now to the drawings, FIG. 1 shows a block diagram of an electronic device 1 having a processor 2 and memory 3. The memory 3 stores an application 4, a waveform table 5, a dynamic waveform manager 6, an application policy 7, and optionally, a general-purpose memory 8*a* and/or an application analyzer 9*a*.

Application 4 comprises program instructions executable by the processor 2 that requires use of waveforms. The waveform table 5 stores waveforms to be used by application 4 and is characterized by a limited number of waveform entries for storing waveforms. The application 4 requires that a waveform be loaded into the waveform table 5 prior to the application's need of the particular waveform. Accordingly, a dynamic waveform manager 6 comprising program instructions executable by the processor 2 is provided to monitor the execution of the application 4 by the processor 2, and to manage loading and unloading of waveforms required by the application 4 into and out of the waveform table 5 such that each waveform required by the application 4 is loaded in the waveform 5 when it is needed by the application 4. The application policy 7 stores waveform sequencing information specific to the application 4 that is used by the dynamic waveform manager 6 in determining when and which waveforms to load and unload to and from the waveform table 5.

When the application 4 requires use of more waveforms than available waveform entries in the waveform table 5, waveforms that are not loaded in the waveform table 5 are stored in memory 8*a* or 8*b*. Typically, memory 8*a* or 8*b* is slower memory that may reside within (memory 8*a*) or remote from (memory 8*b*) the electronic device 1. Whether residing within or remote from the electronic device 1, the dynamic waveform manager 6 can affect loading and unloading of waveforms between memory 8*a* or 8*b* and waveform table 5 as needed.

An application analyzer 9*a* or 9*b* generates the application policy 7. In one embodiment, the application analyzer 9*a* resides in memory 3 of the device. In an alternative embodiment, the application analyzer 9*b* resides external to the electronic device 1 and is executed by a remote system (not shown). If executed remotely, the application 4 (or a copy thereof) may be loaded onto the remote system for analysis such that the application analyzer 9*b* does not actually access the electronic device 1.

Figure 2:
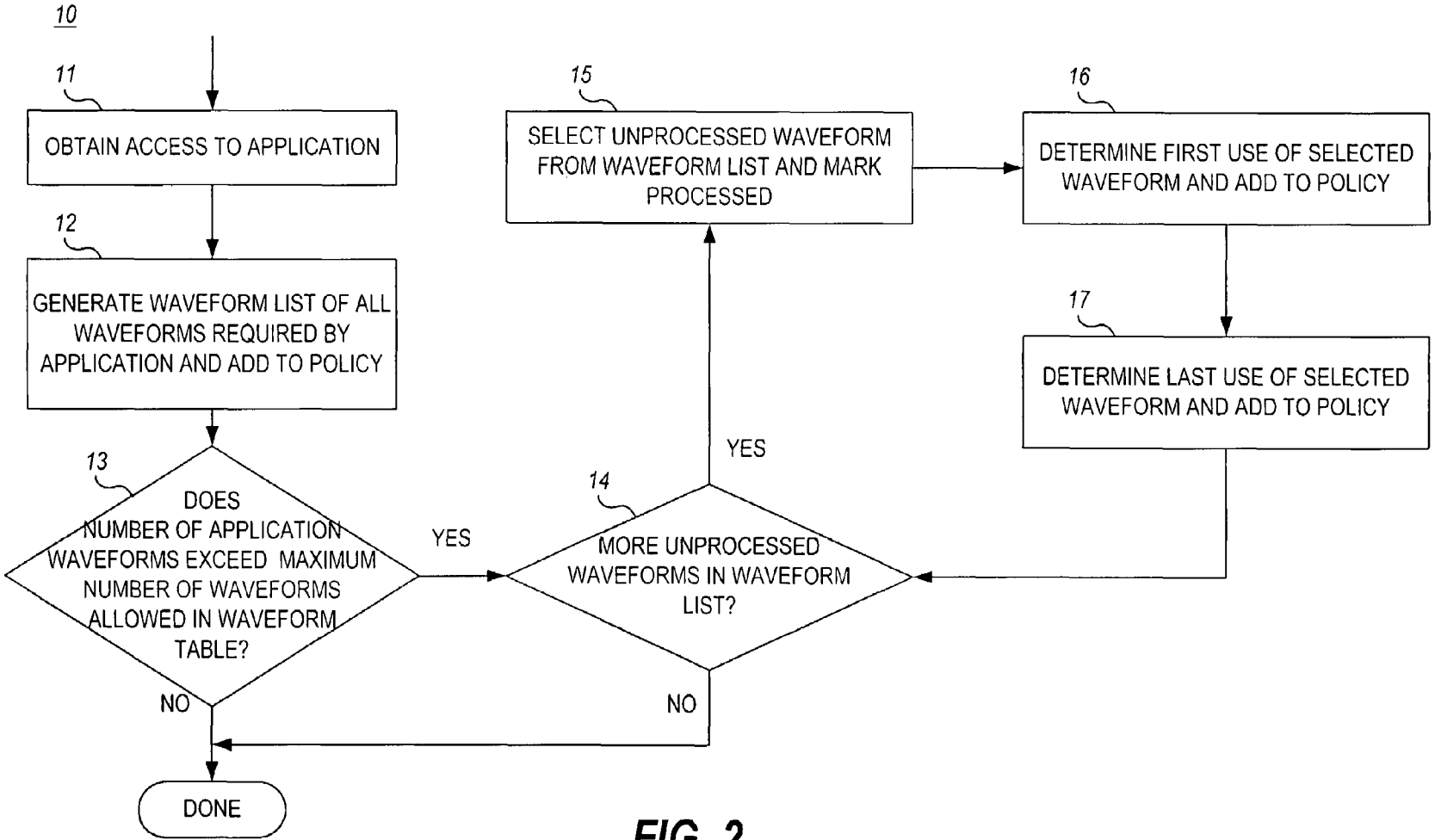
FIG. 2 is a flowchart illustrating a process for generating an application policy.

FIG. 2 is a flowchart detailing an exemplary embodiment 10 of a process executed by an application analyzer 9*a* or 9*b* implemented in accordance with the invention that generates an application policy 7 suitable for use by a dynamic waveform manager 6 to expand the number of waveforms usable by an application program 4. As illustrated in FIG. 2, the application analyzer 10 obtains access to the application program 4 of interest (step 11). In the illustrative embodiment, the application analyzer 10 must be able to determine the sequence of waveforms used by the application program 4 during execution of the application program 4. The application analyzer 10 then generates a list of unprocessed waveforms to be used by the application program 4 (step 12). In the preferred embodiment, waveforms are added to the list in the order that they are discovered by the application analyzer 10. Once the list is generated, a determination is made (step 13) as to whether the number of waveforms required by the application program 4 exceeds the maximum number of waveforms as limited by the system hardware (for example, the number of available entries in the waveform table 5 in FIG. 1). If the number of waveforms required by the application program 4 does not exceed the maximum number of waveforms as limited by the system hardware, sufficient resources exist to run the application program 4 of interest, and no further analysis is required. However, if the number of waveforms required by the application program 4 does exceed the maximum number of waveforms as limited by the system hardware, further analysis is required.

To this end, the waveform list (generated in step 12) is processed on a waveform-by-waveform basis to determine the relative sequence of the first and last use of the waveform by the application program 4. Accordingly, starting with the first discovered waveform in the waveform list, each waveform is processed as follows: A determination is made (step 14) as to whether any unprocessed waveforms in the waveform list (generated in step 12) remain to be processed. If so, one of the remaining unprocessed waveforms in the list is selected for processing (and marked as processed for notice on further passes) (step 15). In the preferred embodiment, the waveforms are processed in sequential order of discovery. The application analyzer 10 then determines the first use of the selected waveform (step 16) by the application program. The application analyzer 10 then determines the last use of the selected waveform (step 17). Processing of the waveform list (generated in step 12) is repeated (by repeating steps 14–18) until each waveform in the waveform list has been processed by the application analyzer 10. Upon completion of processing, the waveform list contains the waveform use and sequencing information required by the dynamic waveform manager 6 for dynamically managing loading and unloading of waveforms into and out of the waveform table 5.

Figure 3:
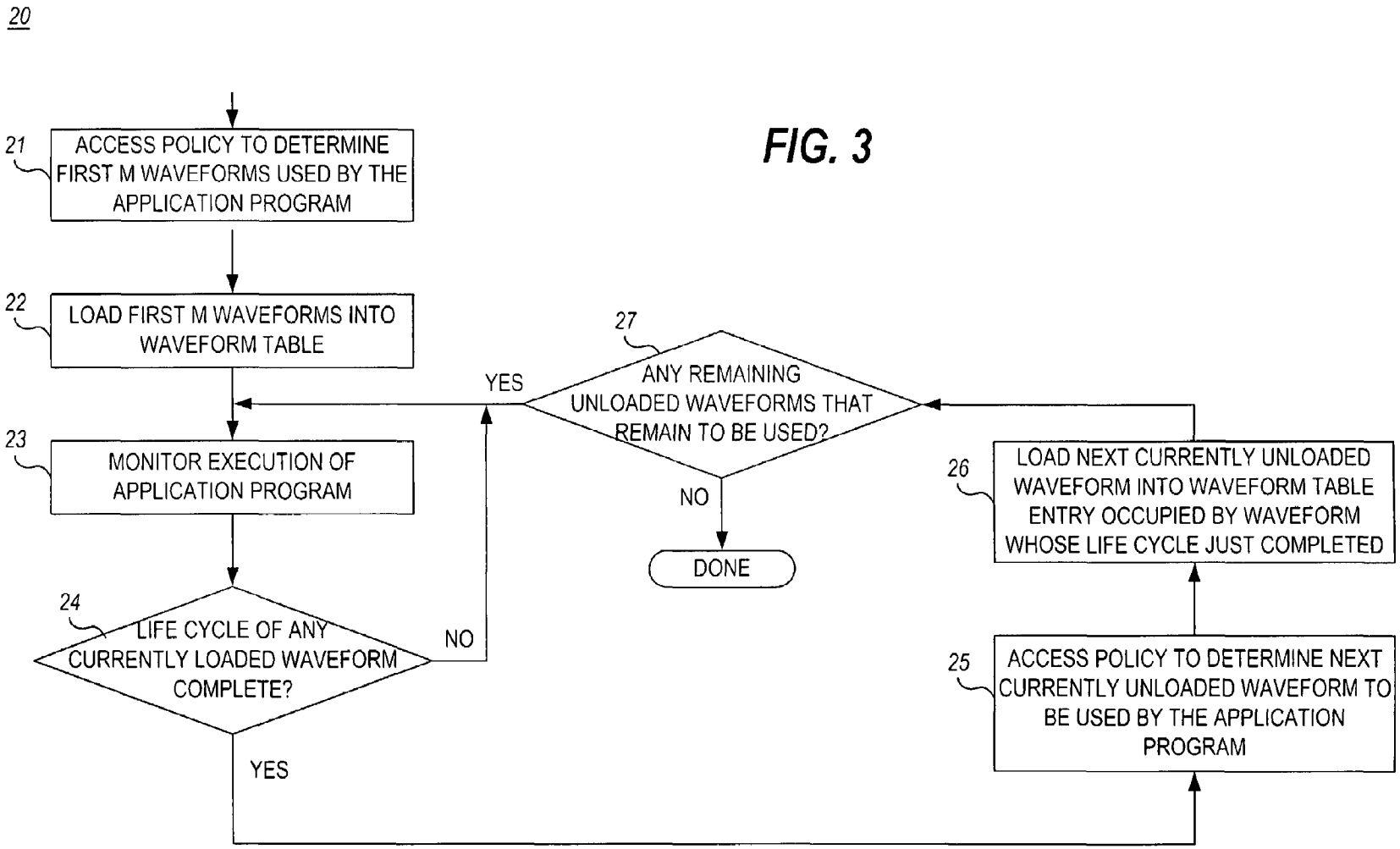
FIG. 3 is a flowchart illustrating a method performed by the dynamic waveform manager of the invention.

FIG. 3 is a flowchart detailing an exemplary embodiment 20 of the dynamic waveform manager 6 of the invention that dynamically manages loading and unloading of waveforms required by an application program 4 into and out of the waveform table 5 during execution of the application 4. In this embodiment 20, the dynamic waveform manager 6 accesses the application policy 7 to select the first m waveforms (step 21) to load into the waveform table 5, determined on a first use basis (step 22). In the illustrative embodiment, m is set to the maximum number of waveform table entries. The dynamic waveform manager 6 monitors execution of the application 4 (step 23), checking to determine (step 24) whether the life cycle of any of the waveforms currently loaded in the waveform table 5 has completed (based on the last use information associated with the waveform as contained in the application policy 7). If the life cycle of any of the currently loaded waveforms has completed, the dynamic waveform manager 6 accesses the application policy 7 to determine and select the next waveform that will be used by the application 4 (step 25). The dynamic waveform manager 6 then effects loading the selected next waveform into the entry of the waveform table 5 that is currently occupied by the waveform whose life cycle it has been determined just completed (step 26). The dynamic waveform manager 6 then determines whether any waveform whose life cycle has not completed remains to be loaded (step 27). If not, the dynamic waveform manager 6 continues to monitor the progress of the application 4, and the algorithm repeats (including steps 23 through 27), until the life cycles of all waveforms required by the application 4 are either complete or the waveform currently loaded.

Figure 4:
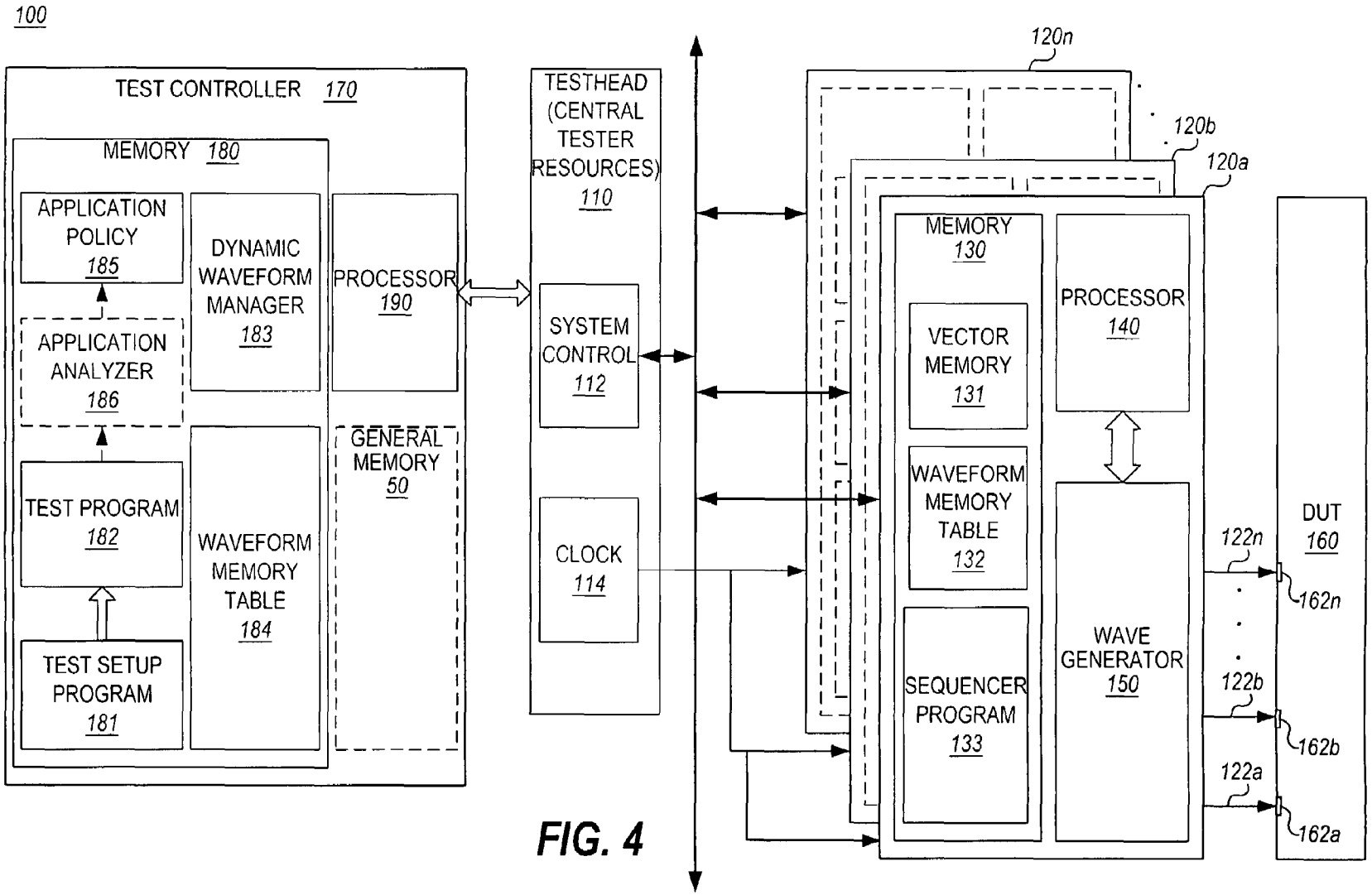
FIG. 4 is a schematic block diagram of a preferred embodiment of an automated test system that utilizes the invention.

FIG. 4 is a schematic block diagram illustrating a specific application of the invention. In this embodiment, a test system 100 includes a testhead 110 with central test resources and a plurality of independent dedicated pin processing resources 120*a*, 120*b*, . . . , 120*n*, each of which drives a respective tester pin 122*a*, 122*b*, . . . , 122*n*. The test system 100 is designed to test a device under test (DUT) 160, such as an integrated circuit or a system-on-a-chip (SOC). In operation, the tester pins 122*a*, 122*b*, . . . , 122*n* contact pins or pads 162*a*, 162*b*, . . . , 162*n* of the DUT 160. Signals may be driven on to the DUT pins or pads 162*a*, 162*b*, . . . , 162*n* (or received from the DUT pins or pads 162*a*, 162*b*, . . . , 162*n*) via the tester pins 122*a*, 122*b*, . . . , 122*n* under the control of the test system 100.

As illustrated, the test system 100 is based on a test-processor-per-pin architecture. Each pin 122*a*, 122*b*, . . . , 122*n* has its own dedicated pin processing resource 120*a*, 120*b*, . . . , 120*n*, each of which drives (or receives input from) a different respective DUT pin 162*a*, 162*b*, . . . , 162*n*, as just described. Each pin processing resource 120*a*, 120*b*, . . . , 120*n* includes identical components. Pin processing resource 120*a* is illustrated in detail, and thus the present discussion shall be limited to pin processing resource 120*a* in particular, but applies similarly to each other independent pin processing resource 120*b*, . . . , 120*n* and its respective identical components.

Turning now to the architecture of pin processing resource 120*a*, pin processing resource 120*a* includes an independent processor 140, memory 130, and a wave generator 150. Memory 130 stores all data to be accessed, and all program instructions to be executed, by the processor 140. In particular, memory 130 includes vector memory 131 for storing data vectors, a waveform memory table 132 for storing waveforms, and a sequencer program 133 which implements processor instructions for sequencing the waveforms stored in the waveform memory table 132 to the wave generator 1150.

The pin processing resources 120*a*, 120*b*, . . . , 120*n* will preferably include receive mode circuitry as well, but these details have been omitted since they are not used by, nor affect, the operation of the invention.

The central test resources 110 include system control resources 112 and a clock generator 114. The system control resources 112 operate in conjunction with the clock generator 114 to load the sequencer program 133, data vectors into the vector memory 131, and waveforms into the waveform memory table 132 in memory 130 of respective pin processing resources 120*a*, 120*b*, . . . , 120*n*. Because each pin 122*a*, 122*b*, . . . , 122*n* has its own dedicated pin processing resource 120*a*, 120*b*, . . . , 120*n*, an independent sequencing program 133, utilizing an independent set of data vectors and waveforms, can be executed on each pin 122*a*, 122*b*, . . . , 122*n*. Thus, the pin processing resources 120*a*, 120*b*, . . . , 120*n* can be independently driving (and receiving) respective signals to and from the respective pins 122*a*, 122*b*, . . . , 122*n* to perform a test of the DUT 160 as determined by the test controller 170.

The tester controller 170 includes a processor 190 and memory 180. Memory 180 stores test setup software 181, test program(s) 182 generated by the test setup software 181, and a dynamic waveform manager 183. Test controller 170 also stores a local waveform memory table 184, preferably in fast memory. The test setup hardware 181 generates test program(s) 182 which include use of waveforms that will be downloaded to the waveform memory tables 132 of the appropriate pin processing resources 120*a*, 120*b*, . . . . , 120*n* of the tester 100. During execution of a test program by the processor 190, any waveform being used by the test program 182 must be loaded into the waveform table 132 associated with its appropriate pin processing resource 120*a*, 120*b*, . . . , 120*n*. For ease of understanding, the following discussion will refer to a single pin processing resource 120 and its waveform table 132, and the local copy 184 of the waveform table 132 that resides on the test controller 170. However, it is to be understood that the dynamic waveform manager 183 independently manages waveforms used by each of the pin processing resources 120*a*, 120*b*, . . . , 120*n*, maintaining an independent updated copy of their respective waveform tables 132.

Returning now to the management of waveforms for pin processing resource 120*a*, the dynamic waveform manager 183 maintains a local copy 184 of the waveform table 132 in pin processing resource 120*a*. The dynamic waveform manager 183 comprises program instructions for execution by the processor 190 for managing the loading and unloading of waveforms to and from the local waveform table 184 residing in the test controller 170 that is associated with the waveform table 132 of the pin processing resource 120*a* and a general memory 186 that may reside in the test controller 170 or remote from the controller 170.

The dynamic waveform manager 183 monitors execution of the test program 182 by the processor 190, and together with the waveform sequencing information contained in the application policy 185 associated with the test program 182, the dynamic waveform manager 183 determines when and which waveforms to load from general memory 186 into the local waveform table 184 and which waveforms to unload from the local waveform memory table 184 during test execution.

An application analyzer 186 is preferably used to generate the application policy 185 for a given test program 182. The application policy 185 may reside in and execute in the test controller 170, or may analyze the test program 182 on a remote machine. In the preferred embodiment, the application analyzer 186 is integrated into the test setup software 181, and dynamic waveform manager 183 and policy 185 are integrated into the test program 182.

In the illustrative embodiment, the waveform memory table 184 stores up to 4 waveforms. The waveforms stored in the local waveform memory table 184 are sent to the appropriate pin processing resource 120*a* and stored waveform table 132 waveform 150 under the control of the test program 182, processor 190, and testhead controller 112.

On the test controller 170, waveforms are loaded into the local waveform table 184 under the control of the dynamic waveform manager 183. The test controller processor 190 executes the test program 182 and the dynamic waveform manager 183. During execution of the test program 182, the dynamic waveform manager 183 manages loading and unloading of waveforms required by the sequencer program 133 on the pin processing resource 120*a* into and out of the waveform table 132 (via loading into and out of the waveform table 184) such that each waveform required by the sequencer program 133 is loaded in the waveform table 132 prior to and at least by the time it is needed by the sequencer program 133.

The dynamic waveform manager 183 monitors execution of the test program 182 and determines which, if any, of the waveforms in the local waveform table 184 have completed their life cycle and may be removed to allow loading of another waveform still to be used in the test program 182. In making this determination, the dynamic waveform manager 183 consults the application policy 185 associated with the test program 182. The application policy 185 comprises waveform use and sequencing information specific to the test program 182 being executed by the processor 190. In the preferred embodiment, as discussed hereinafter, the application policy 182 includes a list of waveforms required by the test program 182 during execution of the test program 182 and associated timing information (e.g., first and last use of each waveform used by the test program 182).

The application policy 185 is typically a data file stored in memory 180 that is accessible to the dynamic waveform manager 183. The contents of the application policy 185 can be generated manually by a technician or engineer, or alternatively may be generated automatically, for example by an application analyzer 186. An application analyzer 186 analyzes a particular test program 182 to generate an application policy 185 specific to the particular test program 182 that was analyzed. How the analysis is performed, of course, depends on the implementation of the test program 182. In any implementation of the application analyzer 186, the application analyzer 186 must be able to identify use of a waveform and sequence timing of the use of the waveform by the test program 182.

In FIG. 4, the dynamic waveform manager 183 is shown independent of the test program 182, in which case it would execute independently of the test program 182. Such an embodiment requires a method of communication between the dynamic waveform manager 182 and test program 182 in order for the dynamic waveform manager 183 to determine when a waveform is no longer needed by the test program 182. Various communication techniques that would be suitable for communication between two independently executing processes such as the dynamic waveform manager 183 and test program 182 are known in the art, including by way of example only and not limitation: socket connections, remote procedure calls (RPCs), threads, etc.

In the illustrative embodiment, it is contemplated that the dynamic waveform manager 183 will be integrated within the test program 182 itself. Thus, in the illustrative example, the test program 182 is a TestFlow comprising one or more TestSuite objects that is generated from a test setup environment such as Agilent's SmarTest User Interface. In this embodiment, it is contemplated that the dynamic waveform manager 183 would be integrated into the TestFlow test program 182 where it could easily monitor the progress of a TestFlow test program 182 through, for example, sharing of variables, and thereby load and unload waveforms required by the TestFlow test program 182 to and from the waveform table 184 (from general memory 186) as needed. In the illustrative embodiment, it is contemplated that the application analyzer 186 would be integrated into the SmarTest software where it could easily access and analyze a TestFlow test program 182 generated by the SmarTest software.

In the preferred embodiment, the test system 100 is implemented using the 93000 Series SOC ATE. It is to be understood that currently, the 93000 Series SOC ATE allows storage of up to 32 waveform entries in its waveform tables; however, for purposes of ease of illustration, the illustrative embodiment is described herein with an arbitrarily chosen waveform limit of 4. The principles discussed herein, however, extend to any waveform limit number. Also in the preferred embodiment, the test setup software 181 is preferably implemented with the SmarTest User Interface, manufactured by Agilent Technology, Inc. of Palo Alto, Calif. for use with the 93000 Series SOC ATE, and the test program 182 is a preferably a TestFlow generated by the SmarTest software.

Figures 5, 7:
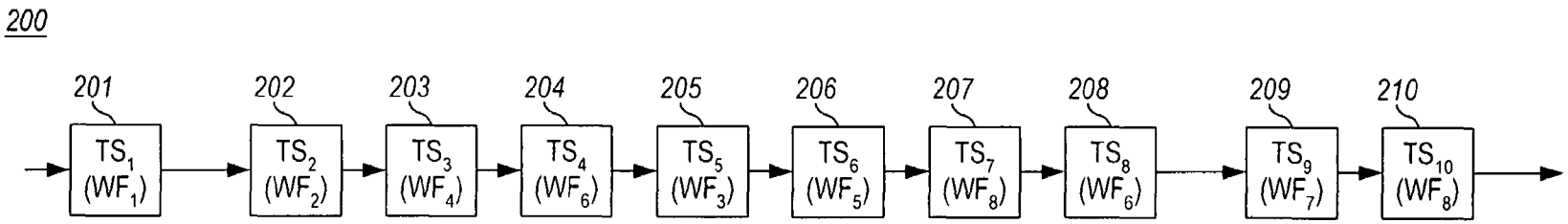
FIG. 5 is a sequence diagram of an example application program.
FIG. 7 is an example waveform list that would be generated by application of the application analyzer method outlined in FIG. 6.

FIG. 5 is a sequence diagram of an example test program called a TestFlow, which, as just described, is part of Agilent's SmarTest User Interface for the Agilent 93000 SOC Series ATE system. TestFlow is a graphical test setup environment that allows a system user to set up and execute various tests of a DUT. The sequence diagram shown in FIG. 5 is a graphical representation of a test program 200 that executes a number of tests, called TestSuites, where each TestSuite may be set up to apply one or more defined waveforms on a defined waveform pin in the tester. The definitions of each TestSuite, for example containing the waveforms and sequence of waveforms to be generated on a pin, are stored in TestSuite objects as object fields. The present invention allows expansion of the number of waveforms that can be used in any given TestFlow test program 200 to an unlimited number.

As illustrated in FIG. 5, the example TestFlow test program 200 includes ten TestSuites $TS_1$ 201, $TS_2$ 202, $TS_3$ 203, $TS_4$ 204, $TS_5$ 205, $TS_6$ 206, $TS_7$ 207, $TS_8$ 208, $TS_9$ 209, and $TS_{10}$ 210. In this example test program, TestSuite $TS_1$ 201 is defined to use a waveform identified as $WF_1$; TestSuite $TS_2$202 is defined to use a waveform identified as $WF_2$; TestSuite $TS_3$ 203 is defined to use a waveform identified as $WF_4$; TestSuite $TS_4$ 204 is defined to use a waveform identified as $WF_6$; TestSuite $TS_5$205 is defined to use a waveform identified as $WF_3$; TestSuite $TS_6$ 206 is defined to use a waveform identified as $WF_5$; TestSuite $TS_7$ 207 is defined to use a waveform identified as $WF_8$; TestSuite $TS_8$ 208 is defined to use a waveform identified as $WF_6$; TestSuite $TS_9$ 209 is defined to use a waveform identified as $WF_7$; and TestSuite $TS_{10}$ 210 is defined to use a waveform identified as $WF_8$.

In the illustrative embodiment, the maximum waveform entries in the waveform table 184 amounts to 4 entries. Accordingly, because the example TestFlow test program 200 of FIG. 5 defines 8 different waveforms that are used during execution of the test program 200, it requires more waveforms than available entries in the waveform memory table 184. The dynamic waveform manager 183 of the invention allows expansion of the number of waveforms usable by a test program 182 to a number greater than that defined by the number of entries in the waveform table 184.

Figure 6:
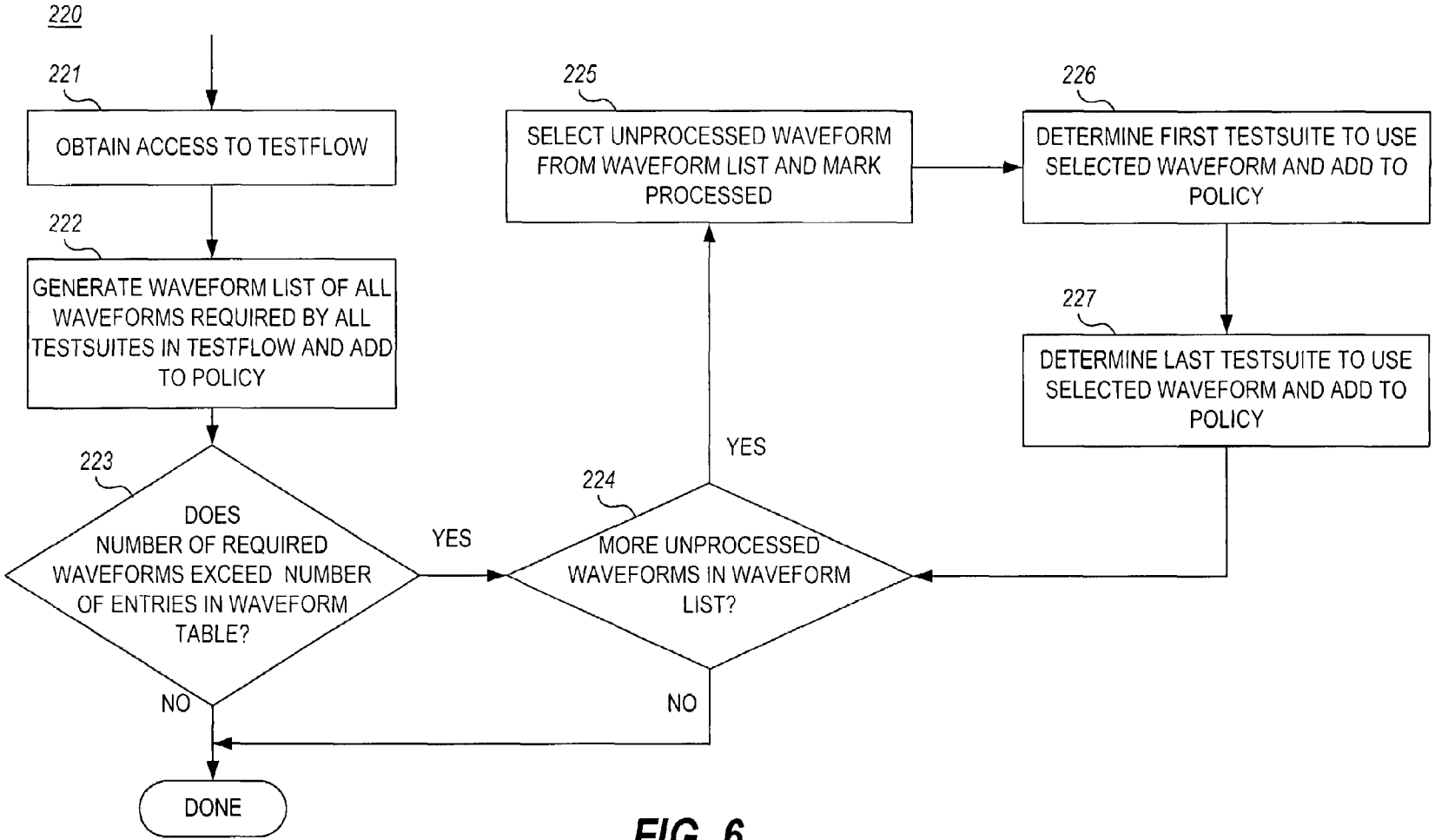
FIG. 6 is a flowchart of a method of operation of an application analyzer generates an application policy for the system of FIG. 4.

FIG. 6 is a flowchart detailing an exemplary embodiment of a method 220 executed by the application analyzer 186 of FIG. 4 that generates an application policy 185 suitable for use by the dynamic waveform manager 183 to allow dynamic waveform management to expand the number of waveforms usable by the TestFlow test program 200 of FIG. 5. As illustrated in FIG. 6, the application analyzer method 220 obtains access to the TestFlow test program 182 (step 221). In the illustrative embodiment, the application analyzer method 220 must be able to determine the sequence of waveforms used by the TestFlow test program 182 during execution of the TestFlow test program 182. The application analyzer method 220 then generates a list of unprocessed waveforms to be used by the TestFlow test program 182 (step 222). In the preferred embodiment, waveforms are added to the list in the order that they are discovered by the application analyzer method 220. Once the list is generated, a determination is made (step 223) as to whether the number of waveforms required by the TestFlow test program 182 exceeds the number of available entries in the waveform table 184. If the number of waveforms required by the TestFlow test program 182 does not exceed the number of available entries in the waveform table 184, sufficient resources exist to run the TestFlow test program 182, and no further analysis is required. However, if the number of waveforms required by the TestFlow test program 182 does exceed the number of available entries in the waveform table 184, further analysis is required.

To this end, the waveform list (generated in step 222) will be processed on a waveform-by-waveform basis to determine the relative sequence of the first use of the waveform and the last use of the waveform by the TestFlow test program 182. Accordingly, starting with the first discovered waveform in the waveform list, each waveform is processed as follows: A determination is made (step 224) as to whether any unprocessed waveforms in the waveform list (generated in step 222) remain to be processed. If so, one of the remaining unprocessed waveforms in the list is selected for processing (and marked as processed for notice on further passes) (step 225). In the preferred embodiment, the waveforms are processed in sequential order of discovery. The application analyzer method 220 then determines the first use of the selected waveform (step 226) by the TestFlow test program 182. In the test program of FIG. 5, for example, the application analyzer method 220 reads the TestFlow sequence 200 in order, accessing the definition objects of each TestSuites 201–-210, to determine which TestSuite 201–210 first uses the selected waveform. The TestSuite 201–210 that first uses the selected waveform is entered into the waveform list and associated with the selected waveform, preferably in table format.

The application analyzer method 220 then determines the last use of the selected waveform by the TestFlow test program 182 (step 227). In the illustrative example, the application analyzer 220 continues reading the TestFlow sequence 200 in order, accessing the definition objects of each TestSuite 201–210, to determine which TestSuite 201–210 last uses the selected waveform. The TestSuite 201–210 that last uses the selected waveform is entered into the waveform list, preferably in table format.

Processing of the waveform list (generated in step 222) is repeated (by repeating steps 224–228) until each waveform in the waveform list has been processed by the application analyzer method 220. Upon completion of processing, the waveform list contains the information required by the dynamic waveform manager 183 for dynamically managing loading and unloading of waveforms into and out of the waveform table 184. Thus, the waveform list may be used as the application policy 185, or alternatively the application policy 185 may be generated from the waveform list into a format required by the dynamic waveform manager 183.

FIG. 7 illustrates an example waveform list 230 that would be generated by application of the application analyzer method 220 outlined in FIG. 6 to the example TestFlow test program 200 of FIG. 5. As shown therein, the waveform list 230 includes a column of waveform identifiers, a column listing the TestSuite that first uses the waveform associated with the waveform identifier in its row, and a column listing the TestSuite that last uses the waveform associated with the waveform identifier in its row. Based on this information, the dynamic waveform manager 183 can dynamically manage loading and unloading of the waveforms required by the TestFlow test program 182 into and out of the waveform table 184 during execution of the TestFlow program 182 such that each waveform required by the TestFlow program 182 is loaded and available when it is required by the TestFlow program 182.

Figure 8:
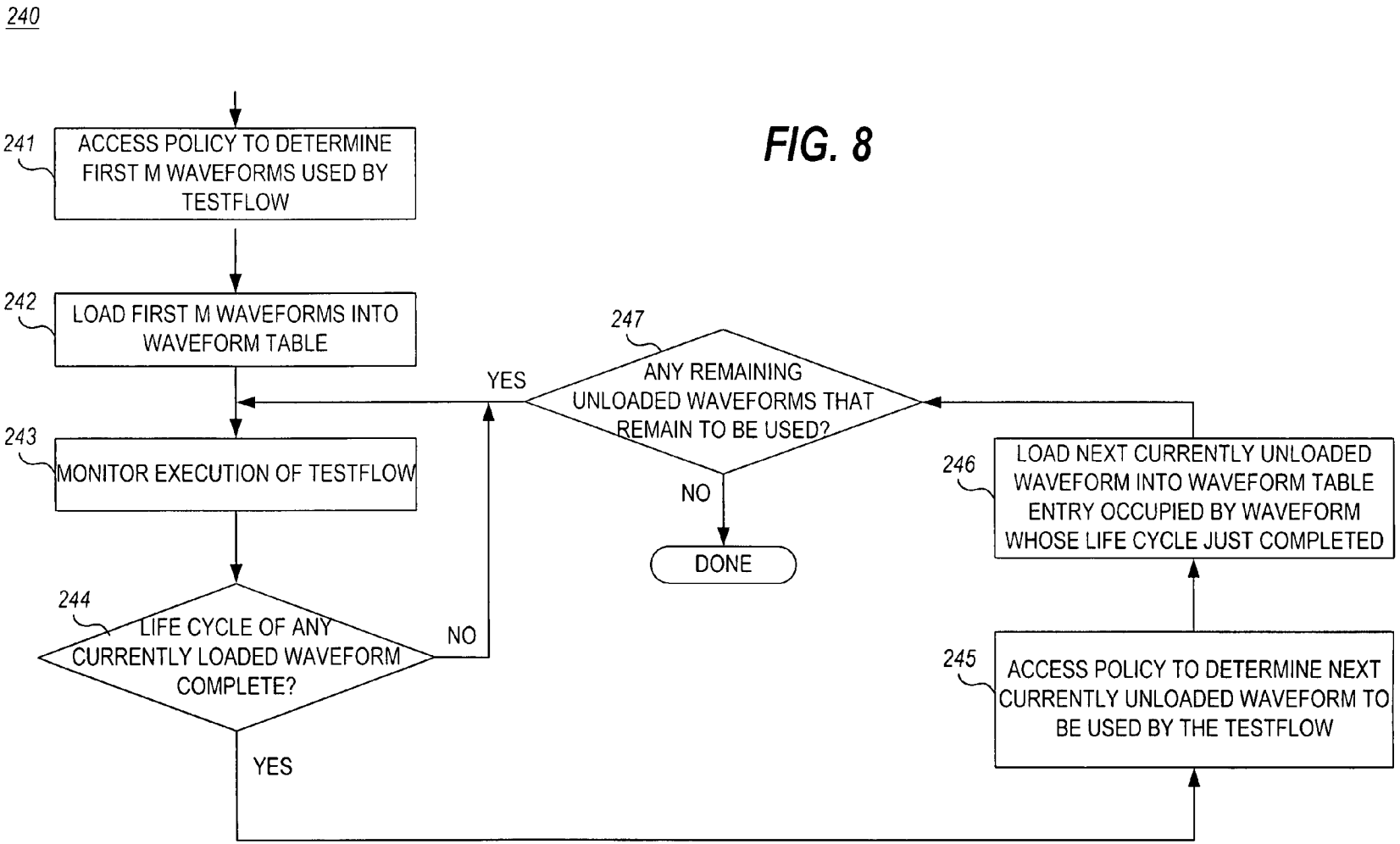
FIG. 8 is a flowchart of a method of operation of the dynamic waveform manager of FIG. 4.

FIG. 8 is a flowchart detailing an exemplary embodiment of a method 240 executed by the dynamic waveform manager 183 of FIG. 4 that dynamically manages loading and unloading of waveforms required by the TestFlow test program 182 into and out of the waveform table 184 during execution of the TestFlow test program 182. In this method 240, the dynamic waveform manager 183 accesses the policy 185 to select the first m waveforms (step 241) to load into the waveform table 184, determined on a first use basis (step 242). In the illustrative embodiment, m=4, indicating that the waveform table 184 is limited to 4 waveform entries. The dynamic waveform manager 183 monitors execution of the TestFlow test program 182 (step 243), checking to determine (step 244) whether the life cycle of any of the waveforms currently loaded in the waveform table 184 has completed (based on the last use information associated with the waveform as contained in the application policy 185). If the life cycle of any of the currently loaded waveforms has completed, the dynamic waveform manager 183 accesses the application policy 185 (i.e., the waveform list 230 of FIG. 7) to determine and select the next waveform that will be used by the TestFlow test program 182 (step 245). The dynamic waveform manager 183 then effects loading the selected next waveform into the entry of the waveform table 184 that is currently occupied by the waveform whose life cycle it has been determined just completed (step 246). The dynamic waveform manager 183 then determines whether any waveform whose life cycle has not completed remains to be loaded (step 247). If not, the dynamic waveform manager 183 continues to monitor the progress of the TestFlow test program 182, and the algorithm repeats (including steps 243 through 247), until the life cycles of all waveforms required by the TestFlow test program 182 are either complete or the waveform currently loaded.

The above-described invention is especially advantageous in the automated test environment of FIG. 4, where the waveform memory table 132 holds a limited number of waveforms. During a test, speed is a critical factor in performance. While waveforms could be downloaded to the waveform memory table 132 on the individual pin processing resource 120*a* as needed for execution of a test, the dynamic waveform manager 183 operates to proactively load waveforms from controller memory or other external memory into the waveform memory table 132 of the pin processing resource 120*a* (via the local waveform memory table 184 in the test controller 170) prior to the time that the sequencer program 133 actually needs the waveform. This is advantageous because typically downloading of waveforms takes longer than it takes to execute the test. Therefore, without the dynamic waveform manager 183 proactively loading waveforms into the waveform memory table 132 prior to the time that the sequencer program 133 needs them, a performance hit is suffered while the sequencer waits for the required waveform to be download from the test controller 170 into the waveform memory table 132.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. An apparatus, comprising:

a processor;

an application program executable by said processor that requires use of a first number of waveforms;

a waveform table comprising a second number of waveform table entries for storing waveforms for use by said application program, wherein said first number exceeds said second number;

an application policy comprising waveform sequencing information specific to said application program;

a dynamic waveform manager that monitors execution of said application program, accesses said application policy to determine which of said first number of waveforms are next required by said application program, and loads one or more of said first number of waveforms into a corresponding respective one or more of said second number of waveform table entries in said waveform table.

2. An apparatus in accordance with claim 1, wherein:

said dynamic waveform manager receives indication of a last use by said application program of a completed one of said one or more of said first number of waveforms that are loaded into said corresponding respective one or more of said second number of waveform table entries in said waveform table, accesses said application policy to select a next waveform still to be used by said application program from said plurality of waveforms that are not currently loaded into one of said limited number of waveform table entries, and replaces said completed one of said loaded waveforms with said selected next waveform in said one of said limited number of waveform table entries corresponding to said completed one of said loaded waveforms.

3. An apparatus In accordance with claim 1, wherein:

said dynamic waveform manager retrieves said one or mote of said first number of waveforms to be loaded into said corresponding respective one or more of said second number of waveform table entries in said waveform table before said application program requires said one or more of said first number of waveforms.

4. An apparatus in accordance with claim 1, further comprising:

an application analyzer which accesses said application program to determine said waveform sequencing information specific to said application program and to generate said application policy.

5. An apparatus in accordance with claim 1, wherein said application policy comprises indication of first use and of last use by said application program of each of said first number of waveforms to be used by said application program.

6. An apparatus in accordance with claim 5, wherein:

said dynamic waveform manager loads said first number of waveforms to be used by said application program in order of first use by said application program.

7. An apparatus in accordance with claim 1, further comprising:

a memory for storing said first number of waveforms that is independent of said waveform table.

8. A method for dynamically managing loading of a plurality of waveforms to a waveform table characterized by a limited number of waveform table entries during execution of an application program, said plurality of waveforms being greater in number than said limited number of waveform table entries, said method comprising:

determining a subset of said plurality of waveforms to be used first by said application program;

loading of each of said subset of said waveforms to a respective one of said limited number of waveform table entries;

receiving indication of a last use by said application program of a completed one of said loaded waveforms loaded at a corresponding one of said limited number of waveform table entries;

selecting a next waveform still to be used by said application program from said plurality of waveforms that are not currently loaded into one of said limited number of waveform table entries;

replacing said completed one of said loaded waveforms with said selected next waveform in said one of said limited number of waveform table entries corresponding to said completed one of said loaded waveforms.

9. A method in accordance with claim 8, comprising:

repeating said receiving step through said replacing step until all of said plurality of waveforms have completed last use or are currently loaded into one of said limited number of waveform table entries.

10. A method in accordance with claim 8, wherein said selecting step and said replacing step are performed prior to requirement of said selected next waveform by said application program.

11. A method in accordance with claim 8, further comprising:

prior to execution of said application program, accessing said application program to determine said waveform sequencing information specific to said application program; and generating said application policy based on said waveform sequencing information specific to said application program.

12. A method in accordance with claim 11, wherein said waveform sequencing information specific to said application program comprises:

indication of first use and of last use by said application program of each of said plurality of waveforms to be used by said application program.

13. A method in accordance with claim 12, wherein said step for determining said subset of said plurality of waveforms to be used first by said application program comprises:

accessing said application policy to obtain said indication of first use by said application program of each of said plurality of waveforms, and selecting said subset of said plurality of waveforms according to order of first use by said application program.

14. A computer readable storage medium tangibly embodying program instructions implementing a method for dynamically managing loading of a plurality of waveforms to a waveform table characterized by a limited number of waveform table entries during execution of an application program, said plurality of waveforms being greater in number than said limited number of waveform table entries, said method comprising the steps of:

determining a subset of said plurality of waveforms to be used first by said application program;

loading of each of said subset of said waveforms to a respective one of said limited number of waveform table entries;

receiving indication of a last use by said application program of a completed one of said loaded waveforms loaded at a corresponding one of said limited number of waveform table entries;

selecting a next waveform still to be used by said application program from said plurality of waveforms that are not currently loaded Into one of said limited number of waveform table entries;

replacing said completed one of said loaded waveforms with said selected next waveform in said one of said limited number of waveform table entries corresponding to said completed one of said loaded waveforms.

15. The computer readable storage medium of claim 14, comprising:

repeating said receiving step through said replacing step until all of said plurality of waveforms have completed last use or are currently loaded into one of said limited number of waveform table entries.

16. The computer readable storage medium of claim 14, wherein said selecting step and said replacing step are performed prior to requirement of said selected next waveform by said application program.

17. The computer readable storage medium of claim 14, further comprising:

prior to execution of said application program, accessing said application program to determine said waveform sequencing information specific to said application program; and generating said application policy based on said waveform sequencing information specific to said application program.

18. The computer readable storage medium of claim 17, wherein said waveform sequencing information specific to said application program comprises:

indication of first use and of last use by said application program of each of said plurality of waveforms to be used by said application program.

19. The computer readable storage medium of claim 18, wherein said step for determining said subset of said plurality of waveforms to be used first by said application program comprises:

accessing said application policy to obtain said indication of first use by said application program of each of said plurality of waveforms, and selecting said subset of said plurality of waveforms according to order of first use by said application program.

* * * * *

UNITED STATES PATENT AND TRADEMARK OFFICE

CERTIFICATE OF CORRECTION

PATENT NO. : 7,024,322 B2
APPLICATION NO. : 10/782984
DATED : April 4, 2006
INVENTOR(S) : Kolman et al.

It is certified that error appears in the above-identified patent and that said Letters Patent is hereby corrected as shown below:

On the title page, below field (56), in "Assistant Examiner", in column 2, line 1, delete "Hien Vo" and insert -- Hien X. Vo --, therefor.

In column 10, line 55, in Claim 3, delete "ln" and insert -- in --, therefor.

In column 10, line 57, in Claim 3, delete "mote" and insert -- more --, therefor.

In column 12, line 23, in Claim 14, delete "Into" and insert -- into --, therefor.

Signed and Sealed this

Nineteenth Day of December, 2006

JON W. DUDAS
*Director of the United States Patent and Trademark Office*